US005246112A

United States Patent [19]

Stout et al.

[11] Patent Number: 5,246,112

[45] Date of Patent: Sep. 21, 1993

[54] ENCLOSED BOTTLE CARRIER

[75] Inventors: James T. Stout, Ellijay; James B. DeMaio, Marietta, both of Ga.

[73] Assignee: The Mead Corporation, Dayton, Ohio

[21] Appl. No.: 940,006

[22] Filed: Sep. 3, 1992

[51] Int. Cl.[5] ..... B65D 65/00

[52] U.S. Cl. ..... 206/427; 206/140; 206/147; 206/155; 229/40

[58] Field of Search ..... 206/427, 434, 140, 147, 206/155, 141, 145; 229/40

[56] References Cited

U.S. PATENT DOCUMENTS

| | | | |
|---|---|---|---|
| 4,096,985 | 6/1978 | Wood | 229/40 |
| 4,216,861 | 8/1980 | Oliff | 206/427 |
| 4,440,340 | 4/1984 | Bakx | 229/40 |
| 4,577,799 | 3/1986 | Oliff | 229/40 |
| 4,925,019 | 5/1990 | Ganz et al. | 206/145 |
| 5,098,015 | 3/1992 | Calvert | 229/40 X |
| 5,197,598 | 3/1993 | Stout et al. | 206/141 |

*Primary Examiner*—Bryon P. Gehman
*Attorney, Agent, or Firm*—Rodgers & Rodgers

[57] ABSTRACT

A bottle carrier for packaging and gripping in a taut fashion, a plurality of bottles includes top, bottom and side walls, each side wall having a substantially vertically disposed bottom portion and preferably inwardly inclined top portion foldably joined to the bottom portion to form a tubular structure. Top end panels are foldably joined to each end edge of the top wall together with a bottom end panel foldably joined to each end edge of the bottom wall and secured in overlapping relation with the associated top end panel. Special web structure is foldably joined to the end edges of the vertically disposed lower portions of the side walls and to the inwardly inclined upper portions of the side walls so as to close the carton ends and to grip the packaged bottles in a taut and secure manner thereby to minimize bottle breakage.

10 Claims, 3 Drawing Sheets

ENCLOSED BOTTLE CARRIER

TECHNICAL FIELD

This invention relates to carriers for packaging bottles and which are specially constructed to prevent bottle breakage due to collision between adjacent bottles.

BACKGROUND ART

U.S. Pat. No. 3,904,036 issued Sep. 9, 1975 and owned by the assignee of this invention discloses a fully enclosed bottle container and includes a so-called false score formed in the bottom wall.

Canadian patent 1,166,211 owned by the assignee of this invention discloses a carton for beverage containers which is similar in some respects to this invention.

U.S. patent application Ser. No. 922,571 filed Jul. 30, 1992, now U.S. Pat. No. 5197598 and owned by the assignee of this invention discloses and claims a carrier which is directed to the problem of minimizing bottle breakage by imparting an inward taut gripping force to the group of bottles packaged within the carrier thereby to minimize the possibility of damage to the bottles due to collisions between adjacent bottles.

SUMMARY OF THE INVENTION

This invention in one form provides an enclosed bottle carrier having top, bottom and side walls wherein each side wall includes a bottom portion and a top portion, said top, bottom, and side walls being interconnected to form a tubular structure. A top end panel is foldably joined to each end edge of said top wall and similar structure is foldably joined to the bottom wall. Web structure is foldably joined to the end edges of the bottom and top portions of each side wall so as effectively to close the carton ends when manipulated into set up condition and which also imparts substantial inward forces to the packaged bottles so as to hold the bottles in snug relationship and to guard against bottle collision and resulting bottle breakage.

BEST MODE OF CARRYING OUT THE INVENTION

Figure 2:
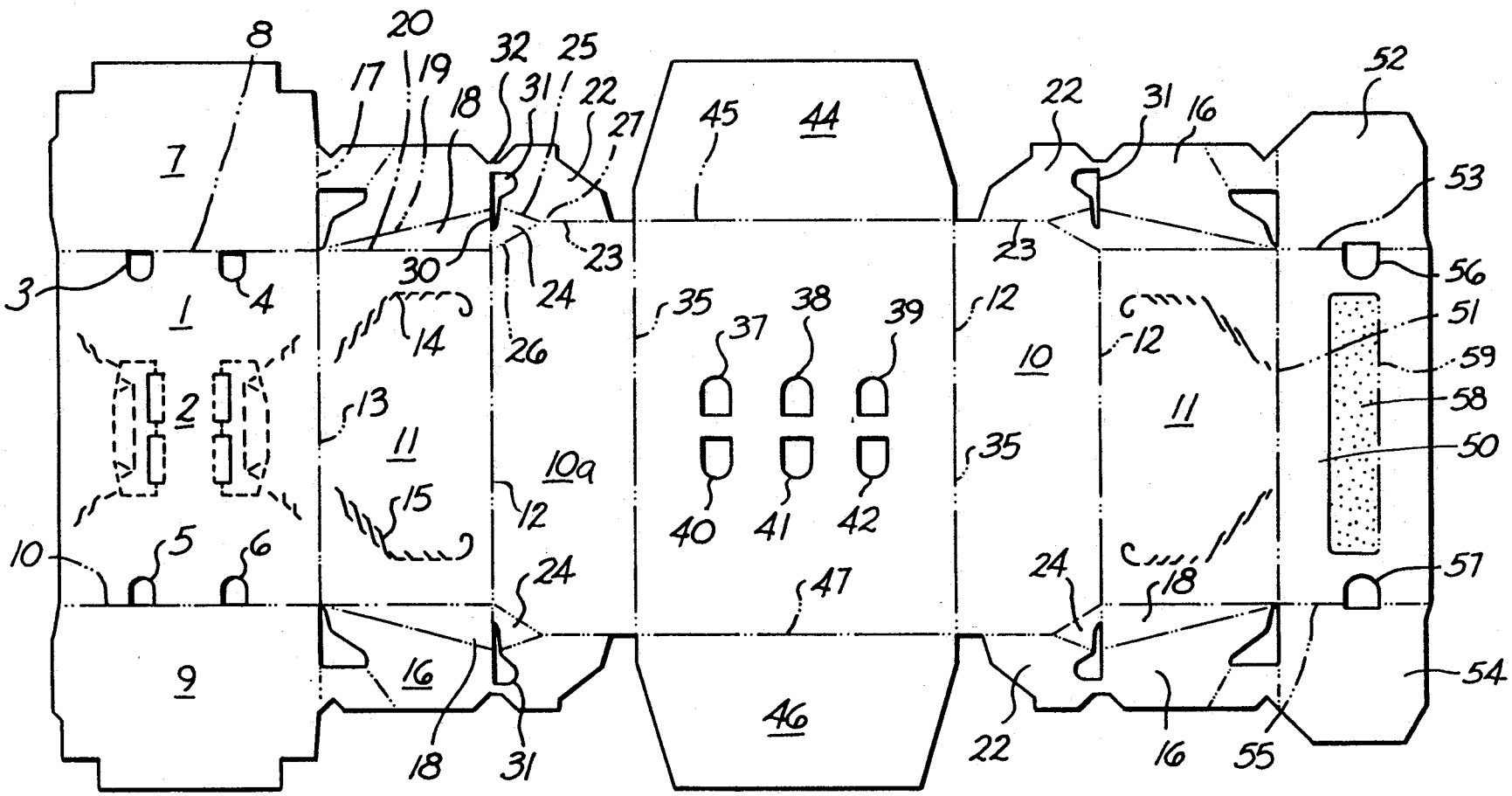
FIG. 2 is a plan view of a blank as viewed from the inside and which embodies this invention.

With reference to FIG. 2, the top wall is designated by the numeral 1. Parts of the carton handle structure are generally designated by the numeral 2 and U-shaped tabs 3, 4, 5 and 6 are struck from the top wall 1. Top end panel 7 is foldably joined to top wall 1 along fold line 8 and top end panel 9 is foldably joined to top wall 1 along fold line 10.

In the preferred embodiment, the bottom upright portion of one side wall is designated by the numeral 10 and an inwardly inclined top wall portion 11 is foldably joined to the lower portion 10 along a fold line 12 and inwardly inclined portion 11 is foldably joined to top wall 1 along fold line 13. In an alternate embodiment (not shown), top wall portion 11 is not inwardly inclined, but rather is coplanar with lower portion 10. In such a case, fold line 12 may be omitted, and both portions may be formed as a single wall panel.

Conventional tear strips 14 and 15 are struck from panel 11 and from top wall 1.

Suitable web structure formed according to this invention includes a first web panel 16 foldably joined to top end panel 7 along fold line 17. A second triangular web panel 18 is foldably joined to first web panel 16 along fold line 19. Second triangular web panel 18 is foldably joined along line 20 to the adjacent end of the inwardly inclined upper portion of one side wall. Fold line 20 is substantially perpendicular to line 12, and substantially vertical when the carton is set up.

Third web panel 22 is foldably joined to the lower upright portion 10 of one side wall along fold line 23. Fold line 23 is substantially perpendicular to fold line 12, and is substantially parallel to and offset from fold line 20, and when the carton is set up, and is substantially vertical. A fourth web panel 24 is of a triangular configuration and is defined by weakened fold lines 25 and 26 which diverge upwardly from a point 27 on fold line 23. Adjacent parts of a second triangular web panel 18 coincide with a corresponding side 25 and 26 of the fourth web panel 24. A cutaway area 30 allows the adjacent parts of second triangular web panel 18 and a fourth triangular web panel 24 to move into abutment with each other so as to facilitate manipulation of the web structures during a carrier set up and loading operation. As may be necessary to achieve proper folding, cutaway area 30 may extend inwardly completely to fold lines 20 and 26, or may extend only partially thereto as shown. Cutaway area 31 also aids in manipulation of the webs during a carrier loading operation.

In the preferred embodiment, a bridge portion 32 is foldably interconnected between first and third web panels 16 and 22 to assist in folding panels 16 and 22 following carrier loading, and in maintaining the panels in position during subsequent gluing of the carrier ends. If desired, however, it is possible to omit bridge portions 32, whereby cutaway areas 31 take the form of notches rather than openings, particularly if cutaway areas 30 extend inwardly only partially toward fold lines 20 and 26.

The angular relationship between the third and fourth web panels is preferable such that the third web panel extends inwardly at a right angle to the lower side wall portion 10*a* and presents a flat and substantially vertical surface for gluing when the bottom end panel 46 is folded into overlapping face contacting relationship therewith. In addition, fourth web panel 24 helps to maintain the third web panel 22 in engagement with the lower portions of the adjacent corner bottles.

Web structure at the other end of the carrier is identical to that just described and includes first web panel 16, second triangular web panel 18, third web panel 22 and fourth web panel 24.

The bottom edge 35 of the lower portion 10 of one side wall is foldably joined to the bottom wall 36 along fold line 35. Openings 37, 38, 39, 40, 41 and 42 are formed in bottom wall 36 and facilitate manipulation of the carrier during feeding and setting up operations. Bottom end panel 44 is foldably joined to bottom wall 36 along fold line 45 and bottom end panel 46 is foldably joined to bottom wall 36 along fold line 47.

The remaining side wall structure as well as the web structures previously described are identical to those shown in FIG. 2 and a detailed description of these parts is not deemed necessary. The same numerals are applied to designate both sets of parts.

In order to interconnect the opposite ends of the blank as shown in FIG. 2 to form a tubular enclosure, lap panel 50 is foldably joined to inwardly inclined panel 11 along fold line 51 and end panel 52 is foldably joined to panel 50 along fold line 53. At the other side of the blank end panel 54 is foldably joined to panel 50 along fold line 55. U-shaped cutouts 56 and 57 are positioned as shown in FIG. 2.

Figure 1:
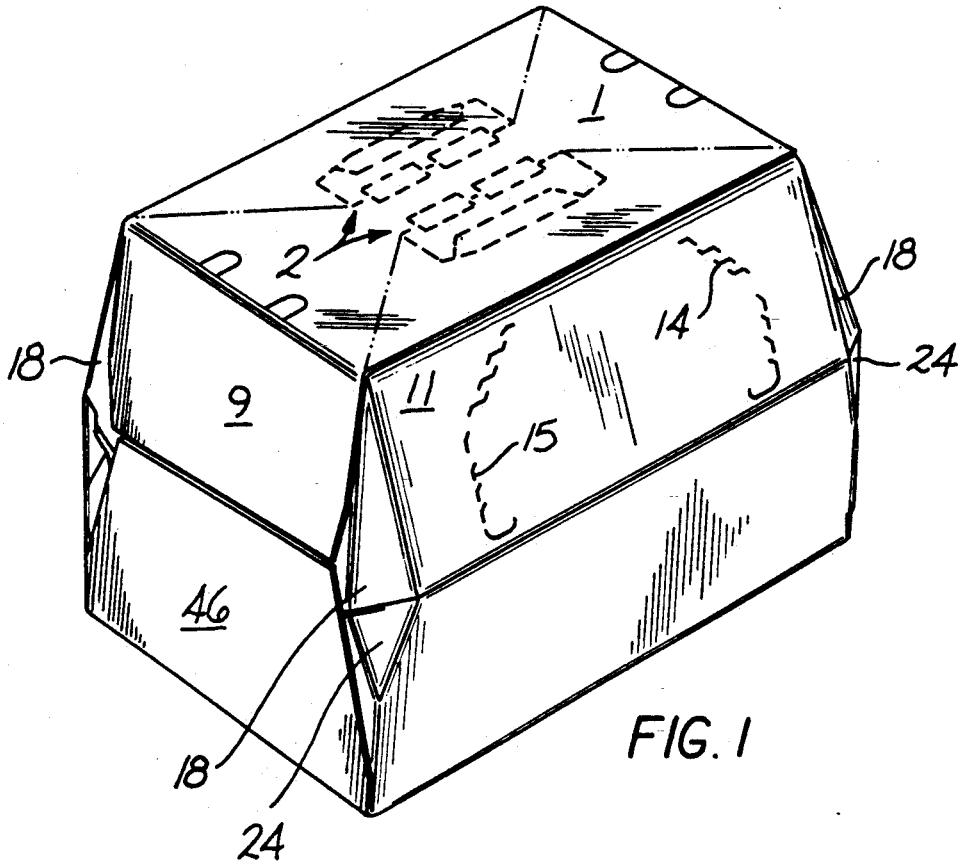
FIG. 1 is a perspective view of a fully set up and enclosed carrier formed according to this invention.
Figure 4:
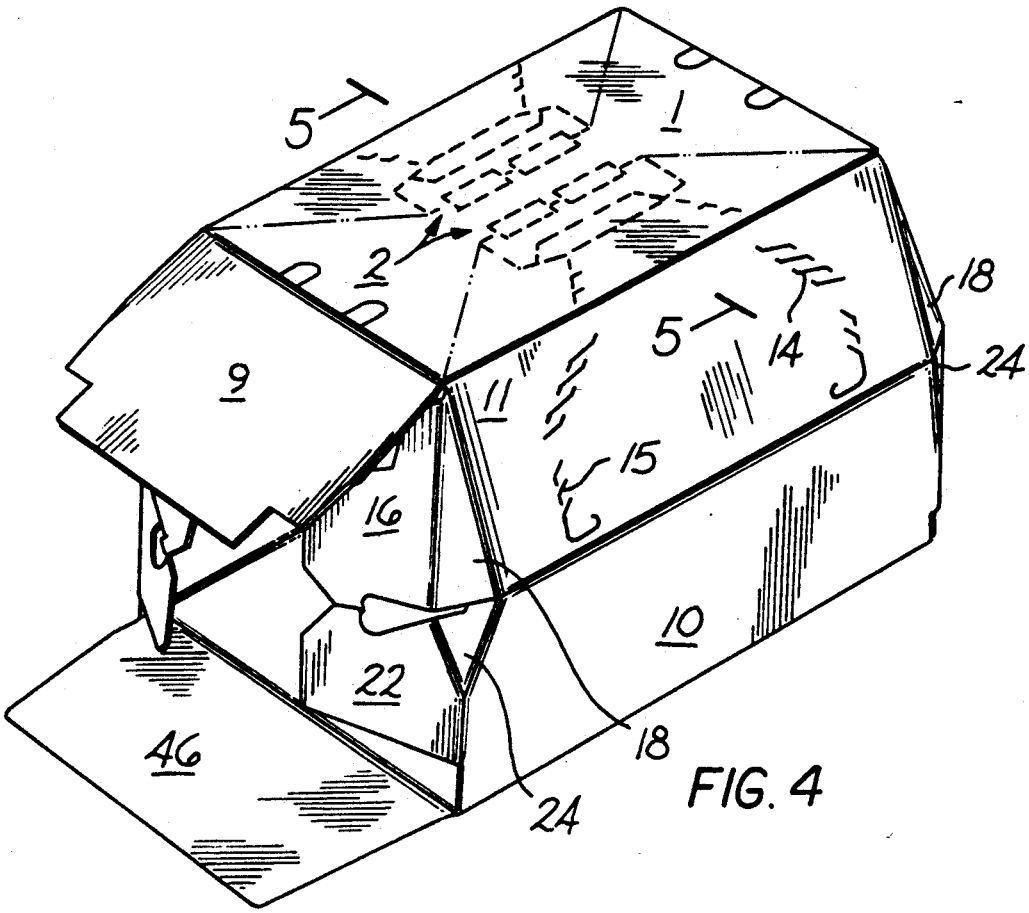
FIG. 4 is a view similar to FIG. 1 but which shows the near end of the carrier with the end closure panels and the web structures in partially set up condition.
Figure 3:
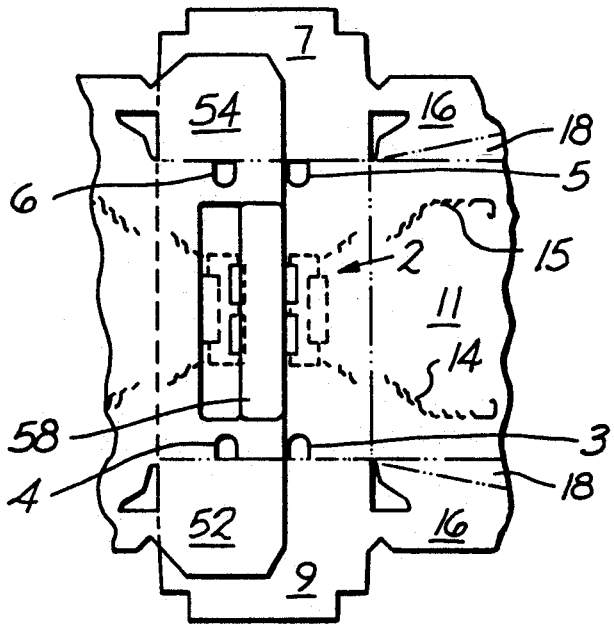
FIG. 3 is an enlarged fragmentary view of the top wall and adjacent panels of a carrier formed according to this invention as viewed from the inside.
Figure 5:
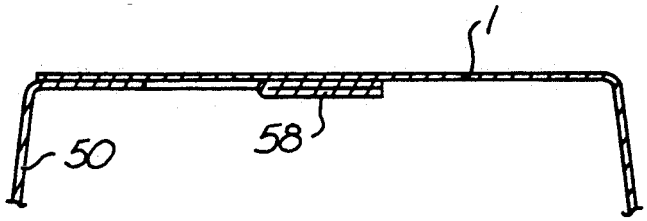
FIG. 5 is a cross sectional view of the top wall taken along the line 5—5 of FIG. 4.

In order to set the carrier up from the condition shown in FIG. 2 to that shown in FIGS. 1 and 4, an application of glue is made to the reinforcing panel 58 as indicated by stippling in FIG. 2. Thereafter the reinforcing panel is elevated and folded toward the right along fold line 59. This operation of course causes the reinforcing panel 58 to become adhered to the inner surface of the panel 50. Thereafter panels 11 and 16 together with panels 50, 52 and 54 are elevated and folded toward the left along the right hand fold line 12. An application of glue is then made to panels 50, 52 and 54, following which panels 11, 16, 1, 7 and 9 are elevated and folded toward the right along the left fold line 12 to cause panel 50 to become adhered to the inside surface of panel 2, as shown in FIG. 3.

Figure 6:
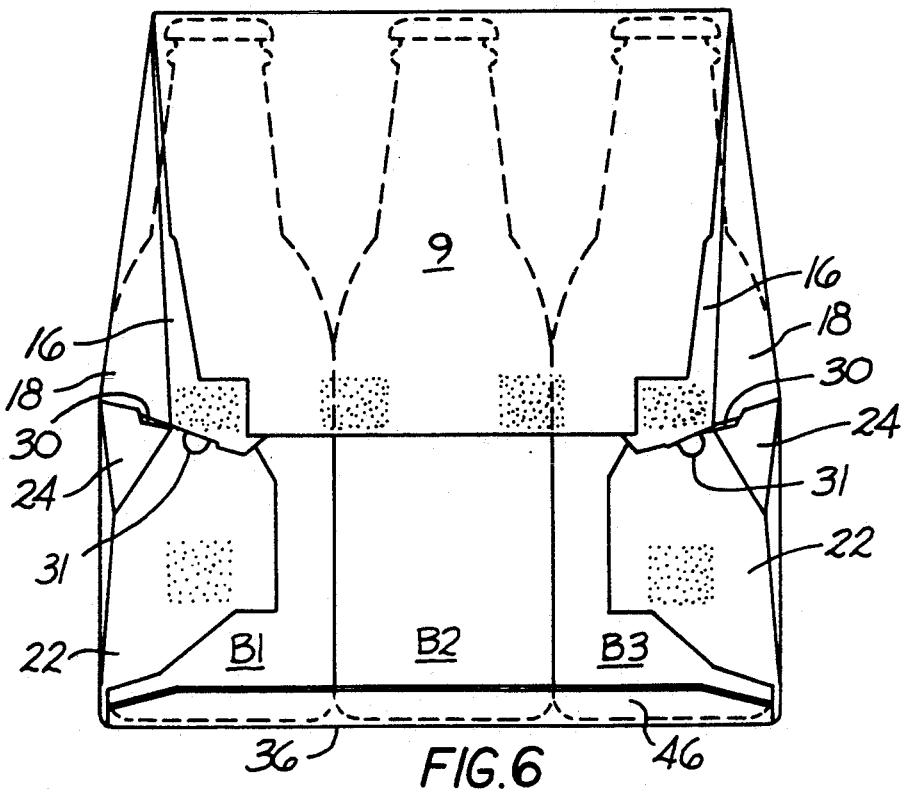
FIG. 6 is a view which shows carrier parts as they appear during closing of an end of the carrier.

The carton may then be set up into open ended condition and loaded through one or both ends. The top and bottom end panels are secured together by glue shown as stippling in FIG. 6. The various web structures are manipulated into fully set up condition and the carton then appears in completed form as shown in FIG. 1.

Access to the contents of the carrier may be had by simply rupturing the tear lines such as 14 and 15 to gain access to the packaged bottles. If bottle return is desired, the empty bottles may be reinserted into the carrier and returned.

We claim:

1. A carrier for a plurality of bottles arranged in a rectilinear configuration and comprising a top wall, a bottom wall and opposed side walls, each side wall having a side wall bottom portion and a side wall top portion separated by a fold line, and said top wall, said bottom wall and said opposed side walls being interconnected to form a tubular structure having opposed ends, a top end panel foldably joined to each end edge of said top wall, a first web panel (16) foldably joined to a side edge of each of the top end panels, a second triangular web panel (18) foldably joined to each of the end edges of each respective side wall top portion along a first fold line (20) which is substantially perpendicular to the bottom edge of its respective side wall top portion and further foldably joined to the adjacent edge of its adjacent first web panel along a second fold line which diverges downwardly from the first fold line so as to position the second triangular web panel in angular relation to the adjacent end of its associated side wall top portion, a third web panel (22) foldably joined to each end of each side wall bottom portion and folded inwardly, and a fourth web panel (24) joined to each end of each side wall bottom portion and its associated third web panel by a pair of fold lines which diverge upwardly from a point on the end edge of the associated side wall bottom portion and which respectively terminate adjacent the lower end of one of the fold lines that define the adjacent second triangular web panel, adjacent third and fourth web panels being related to each other so as to maintain the third web panel in engagement with the adjacent corner bottle of the rectilinear configuration.

2. A bottle carrier according to claim 1 wherein said fourth web panels are disposed astride the corners of said carrier.

3. A bottle carrier-according to claim 1 wherein the lower edges of said second web panels and the adjacent upper edges of said fourth web panels are disposed at said fold lines which define the junction between said top and bottom side wall portions.

4. A bottle carrier according to claim 3 wherein the lower edge of each second web panel and the upper edge of its adjacent fourth web panel is separated by a cutaway.

5. A carrier for bottles arranged in a side-by-side rectilinear group comprising a top wall, a bottom wall, and side walls, each side wall having a bottom side wall portion and a top side wall portion each having opposed end edges, said top, bottom, and side walls being interconnected to form a tubular structure having opposed ends and defining corners, a top end panel foldably joined to each end edge of said top wall along a fold line which extends between opposite corners of the carrier, a first web panel foldably joined to one side edge of each of said top end panels, a second triangular web panel foldably joined to each end edge of each top side wall portion and to the adjacent edge of its adjacent first web panel along a first pair of fold lines which diverge downwardly to define at least in part a third edge of said second triangular web at the junction between the associated bottom side wall portion and its adjacent top side wall portion so as to position each second triangular web panel astride its adjacent corner of the carrier, a third web panel foldably joined to each end edge of each bottom side wall portion, and a fourth web panel defined by a second pair of fold lines between each third web panel and its associated bottom side wall portion end edge, the second pair of fold lines diverge upwardly from a point of intersection on the associated bottom side wall portion end edge and terminate adjacent the lower portions of the adjacent first pair of fold lines at the junction between the associated bottom side wall portion and its adjacent top side wall portions.

6. A bottle carrier according to claim 5 wherein each fourth web panel is of generally triangular configuration defined by its second pair of fold lines in part and by a third fold line which extends for a portion of the distance between the upper portions of said second pair of fold lines.

7. A bottle carrier according to claim 6 wherein the remainder of the distance between the upper portions of said second pair of fold lines is defined by a cutaway.

8. A bottle carrier according to claim 7 wherein said cutaway affords clearance for its adjacent edges whereby said edges move into engagement with each other thereby to impart an inward force to the adjacent third web panel.

9. A bottle carrier according to claim 5 wherein each point of intersection coincides with a fold line between each third web panel and the adjacent end edge of its associated bottom side wall portion, each fourth web panel being disposed astride the adjacent corner of the carrier.

10. A bottle carrier according to claim 5 wherein said top side wall portions are upwardly and inwardly inclined and wherein said end edges of each top side wall portion are substantially perpendicular to the bottom edge of said inwardly inclined top side wall portion.

* * * * *